US007306523B1

(12) United States Patent
Jeffway, Jr. et al.

(10) Patent No.: US 7,306,523 B1
(45) Date of Patent: Dec. 11, 2007

(54) ETROOPS INFRARED SHOOTING GAME

(76) Inventors: Robert W. Jeffway, Jr., 37 Front St., Leeds, MA (US) 01053; Adam Kislevitz, 190 Cedar St., Englewood, NJ (US) 07631; Steven R. Casino, 1 Oak Ave., Tuckahoe, NY (US) 10707

( * ) Notice: Subject to any disclaimer, the term of this patent is extended or adjusted under 35 U.S.C. 154(b) by 119 days.

(21) Appl. No.: 10/941,086

(22) Filed: Sep. 15, 2004

Related U.S. Application Data

(62) Division of application No. 09/915,400, filed on Jul. 27, 2001, now Pat. No. 6,814,667.

(51) Int. Cl.
*A63F 13/00* (2006.01)

(52) U.S. Cl. ..... 463/51; 463/53; 446/175

(58) Field of Classification Search ..... None
See application file for complete search history.

(56) References Cited

U.S. PATENT DOCUMENTS

| | | | | |
|---|---|---|---|---|
| 4,171,811 | A | 10/1979 | Meyer et al. | |
| 4,461,117 | A * | 7/1984 | Gott | 446/473 |
| 4,695,058 | A | 9/1987 | Carter, III et al. | |
| 4,802,675 | A | 2/1989 | Wong et al. | |
| 4,844,475 | A | 7/1989 | Saffer et al. | |
| 5,026,058 | A | 6/1991 | Bromley | |
| 5,120,057 | A | 6/1992 | Kitaue | |
| 5,184,830 | A | 2/1993 | Okada et al. | |
| 5,199,874 | A * | 4/1993 | Campagnuolo et al. | 434/11 |
| 5,212,368 | A | 5/1993 | Hara | |
| 5,253,068 | A | 10/1993 | Crook et al. | |
| 5,411,259 | A | 5/1995 | Pearson et al. | |
| 5,672,108 | A | 9/1997 | Lam et al. | |
| 5,741,185 | A | 4/1998 | Kwan et al. | |
| 5,785,592 | A * | 7/1998 | Jacobsen | 463/7 |
| 5,893,798 | A | 4/1999 | Stambolic et al. | |
| 5,904,621 | A | 5/1999 | Small et al. | |
| 5,961,386 | A | 10/1999 | Sawaguchi | |
| 5,966,226 | A | 10/1999 | Gerber | |
| 6,061,656 | A | 5/2000 | Pace | |
| 6,261,180 | B1 | 7/2001 | Lebensfeld et al. | |

(Continued)

FOREIGN PATENT DOCUMENTS

EP 0 232 157 10/1986

(Continued)

OTHER PUBLICATIONS

WO 93/12399, Jun. 24, 1993.*

*Primary Examiner*—Mark Sager
(74) *Attorney, Agent, or Firm*—McNeely Bodendorf LLP

(57) ABSTRACT

An electronic toy gun for a toy shooting game includes an infrared beam emitter, a trigger, a game data input device, and an internal processor. The infrared beam emitter is configured to emit an encoded infrared beam. The trigger is configured to activate a state of emission of the infrared beam by the infrared beam emitter so as to indicate that a weapon is being fired. The game data input device is configured to receive game data input from a user. The internal processor is configured to receive the game data input from the game data input device and to cause the infrared beam emitter to emit an infrared beam that is coded with one of a plurality of codes based on the game data input.

20 Claims, 10 Drawing Sheets

U.S. PATENT DOCUMENTS 6,302,796 B1 * 10/2001 Lebensfeld et al. ..... 463/51

FOREIGN PATENT DOCUMENTS

| | | |
|---|---|---|
| GB | 2 169 995 | 7/1986 |
| GB | 2 269 655 | 2/1994 |
| WO | WO 92/12399 | 6/1993 |
| WO | WO 98/55817 | 12/1998 |
| WO | WO 99/40386 | 8/1999 |

* cited by examiner

147

147

147

ETROOPS INFRARED SHOOTING GAME

This application is a divisional of prior U.S. application Ser. No. 09/915,400 filed Jul. 27, 2001, now U.S. Pat. No. 6,814,667.

BACKGROUND

This invention relates to infrared weapons games. Infrared weapons games typically involve multiple players using electronic infrared guns to shoot each other with the infrared beams in a mock battle or other mock scenario that can be played indoors and/or outdoors. Each player has an emitter to emit an infrared beam and a detector to detect an infrared beam. The emitter and the detector can be, for example, combined in one infrared toy gun.

SUMMARY

In one aspect the invention is an electronic toy gun for a toy shooting game. The electronic toy gun includes an infrared beam emitter, a trigger, a game data input device, and an internal processor. The infrared beam emitter is configured to emit an encoded infrared beam. The trigger is configured to activate a state of emission of the infrared beam by the infrared beam emitter so as to indicate that a weapon is being fired. The game data input device is configured to receive game data input from a user. The internal processor is configured to receive the game data input from the game data input device and to cause the infrared beam emitter to emit an infrared beam that is coded with one of a plurality of codes based on the game data input.

Embodiments of the electronic toy gun may include one or more of the following features. For example, the game data input may be a code and the internal processor may be configured to retrieve corresponding detailed instructions from a memory corresponding to the code. The game data input device may be a card reader that is configured to read a card that includes game data. The trigger may be configured to activate the state of emission of the infrared beam so as to indicate that the weapon is being fired by varying the encoding of the infrared beam.

The game data input may correspond to characteristics of at least one game character, and the characteristics of the game character may include one or more of the game character's weapons, armor rating, weapon speed rating, and vulnerability, and wherein the infrared beam is coded to reflect the characteristics of the game character. The characteristics of the game character also may include one or both of a weapon beam range and a weapon beam width.

The electronic toy gun may further include a feedback device that is configured to provide variable feedback corresponding a measure of a player's game condition, and the internal processor is further configured to calculate the measure of the player's game condition. The feedback device may be a display that is configured to display one or more of damage to a player, hits to a player, energy remaining, distance between a player and an opponent, characteristics of an opponent's weapon, a depiction of a character associated with the toy gun, and special/defensive weapon usage remaining. The display also may be a liquid crystal display. The feedback device also may be an audio device that is configured to provide one or more of damage to a player, hits to a player, energy remaining, distance between a player and an opponent, characteristics of an opponent's weapon, a character associated with the toy gun, and special/defensive weapon usage remaining.

In another aspect, an electronic toy gun for a toy shooting game also includes a beam detector. The beam detector is configured to detect an infrared beam emitted by another electronic toy gun. The internal processor is configured to receive a signal from the beam detector and to categorize a strength of the infrared beam detected by the beam detector within one of a plurality of strength categories, each category representing infrared beam strength above a minimum threshold.

Embodiments of the electronic toy gun may include one or more of the following features, or any of the features described herein. For example, the detected infrared beam may be registered as a hit based on the strength category detected and based on a nature of a weapon corresponding to the detected infrared beam as indicated by an encoding of the infrared beam. The detected infrared beam may be registered as a hit based on the strength category detected and based on a detected range of a weapon corresponding to the detected infrared beam as indicated by an encoding of the infrared beam. The detected infrared beam may be registered as a hit based on the strength category detected and based on a vulnerability of a game character selected by the user.

In another aspect, the internal processor is configured to select one of a plurality of virtual beam shapes and to cause the infrared beam emitter to emit a selectable infrared beam that is coded with one of a plurality of codes reflecting the differing virtual beam shapes.

Embodiments of the electronic toy gun may include one or more of the following features, or any of the features described herein. For example, the virtual beam shape may be a beam range and/or a beam width.

In another aspect of an electronic toy gun for a toy shooting game, the internal processor is configured to calculate a measure of a player's game condition. A feedback device is configured to provide variable feedback corresponding to the calculation of the measure of the player's game condition.

Embodiments of the electronic toy gun may include one or more of the following features, or any of the features described herein. For example, the feedback device may include a display that is configured to display one or more of damage to a player, hits to a player, energy remaining, distance between a player and an opponent, characteristics of an opponent's weapon, a depiction of a character associated with the toy gun, and special/defensive weapon usage remaining. The feedback device may include an audio device that is configured to provide one or more of damage to a player, hits to a player, energy remaining, distance between a player and an opponent, characteristics of an opponent's weapon, a character associated with the toy gun, and special/defensive weapon usage remaining. The feedback device may be a liquid crystal display.

In another aspect the invention is an infrared toy grenade. The infrared toy grenade includes a grenade body, at least one array of infrared beam emitters, a switch, and a delay. The grenade body is configured to be projected from a first location to a second location. The array of infrared beam emitters are positioned within the body and are configured to emit an array of infrared beams from the body. The switch is configured to be operated to activate the array of infrared beam emitters. The delay is configured to provide a time delay between the operation of the switch and the activation of the array of infrared beam emitters.

The various aspect of the invention provides considerable advantages. For example, interest in the game is enhanced because of the ability to input game data that corresponds to multiple characters and weapons, and their respective characteristics. This game data also makes the game more realistic. The game also is more realistic and requires more skill because hits against a player are determined based on a variety of factors. These factors can be advantageously controlled by the players by their selection of their game characters. Because there are more variables that are similar to a real situation, the game is more realistic and enhances the players' interest in the game. The grenade provides a mode of playing that is different from an electronic toy gun and thereby provides a different way of attacking an opposing player.

The details of one or more embodiments of the infrared weapons game are set forth in the accompanying drawings and the description below. Other features and advantages of the shooting game will be apparent from the description and drawings, and from the claims.

DESCRIPTION OF THE DRAWINGS

Like reference symbols in the various drawings indicate like elements.

DESCRIPTION

The inventors have found that an infrared shooting game can be improved by using an infrared gun that can selectively represent various robots using weapons with different characteristics. The infrared gun that the inventors have created uses one or more encoded infrared beams to shoot opponents and an infrared beam detector to detect shots from opponents' infrared guns, determine distance from the opponent, detect a hit, and determine the amount of damage from the hit. These infrared beams can be wide or narrow.

Figure 1:
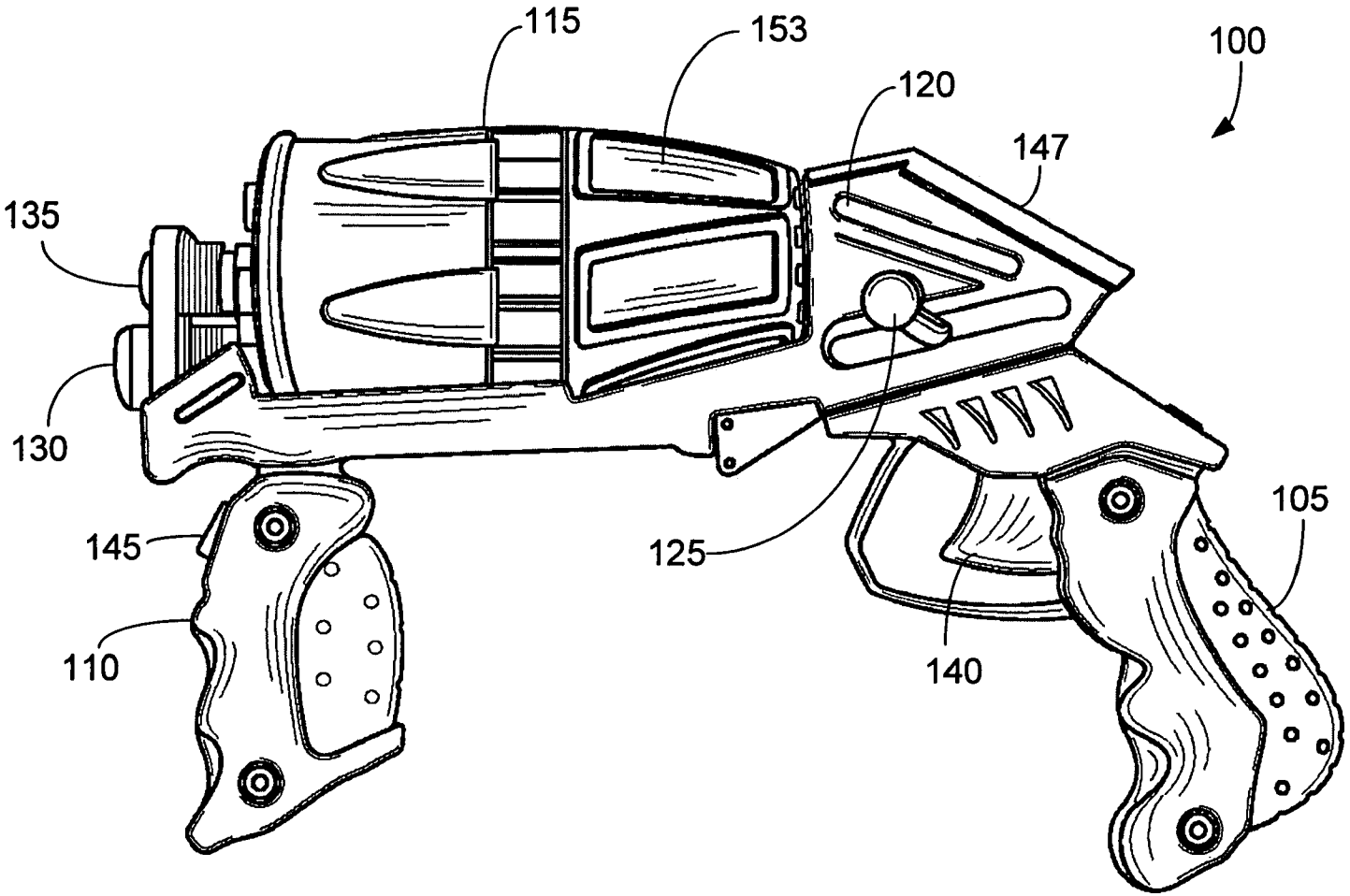
FIG. 1 is a side view of an infrared shooting game gun.
Figure 2:
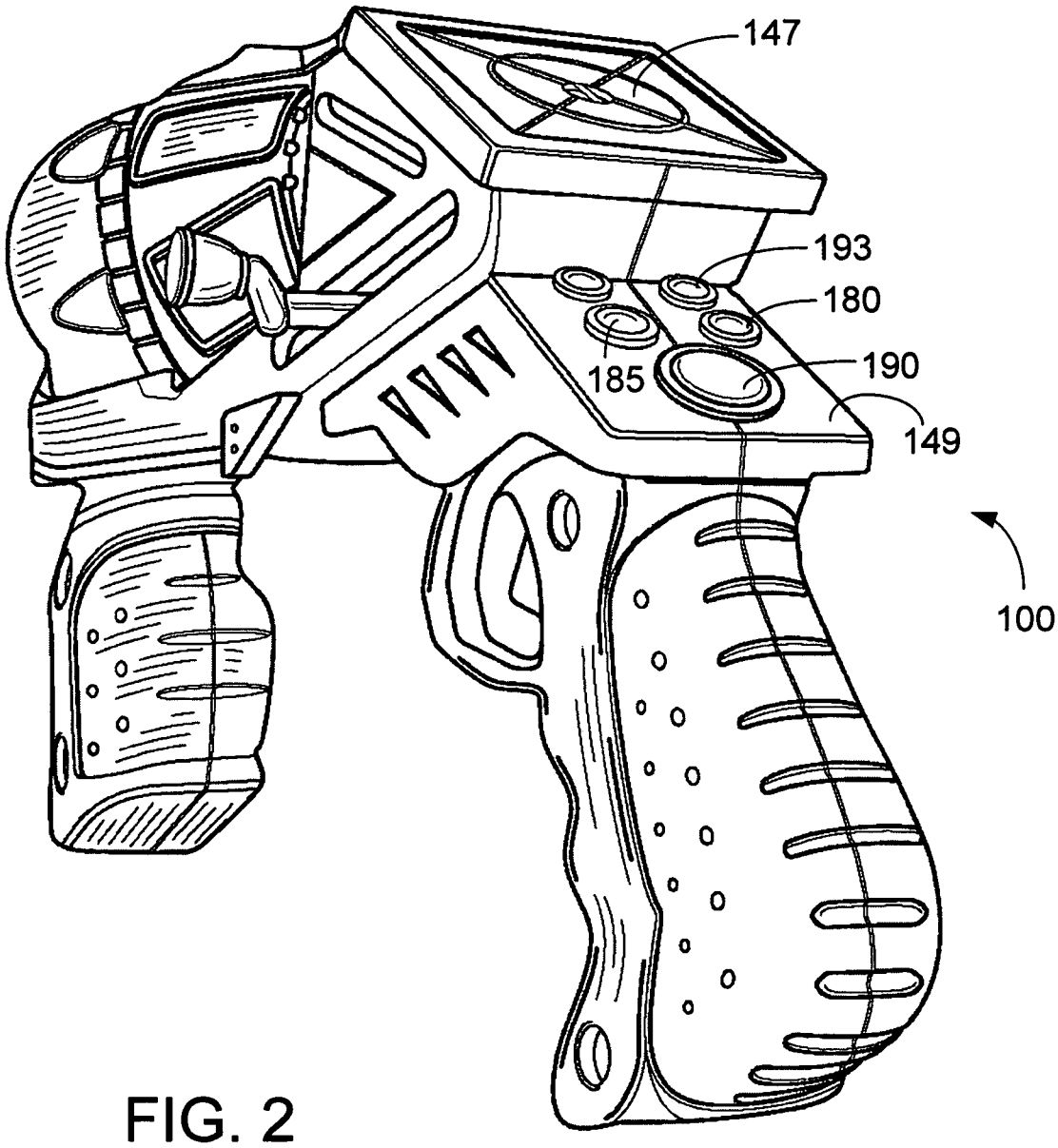
FIGS. 2 and 3 are perspective views of the infrared shooting game gun of FIG. 1.
Figure 3:
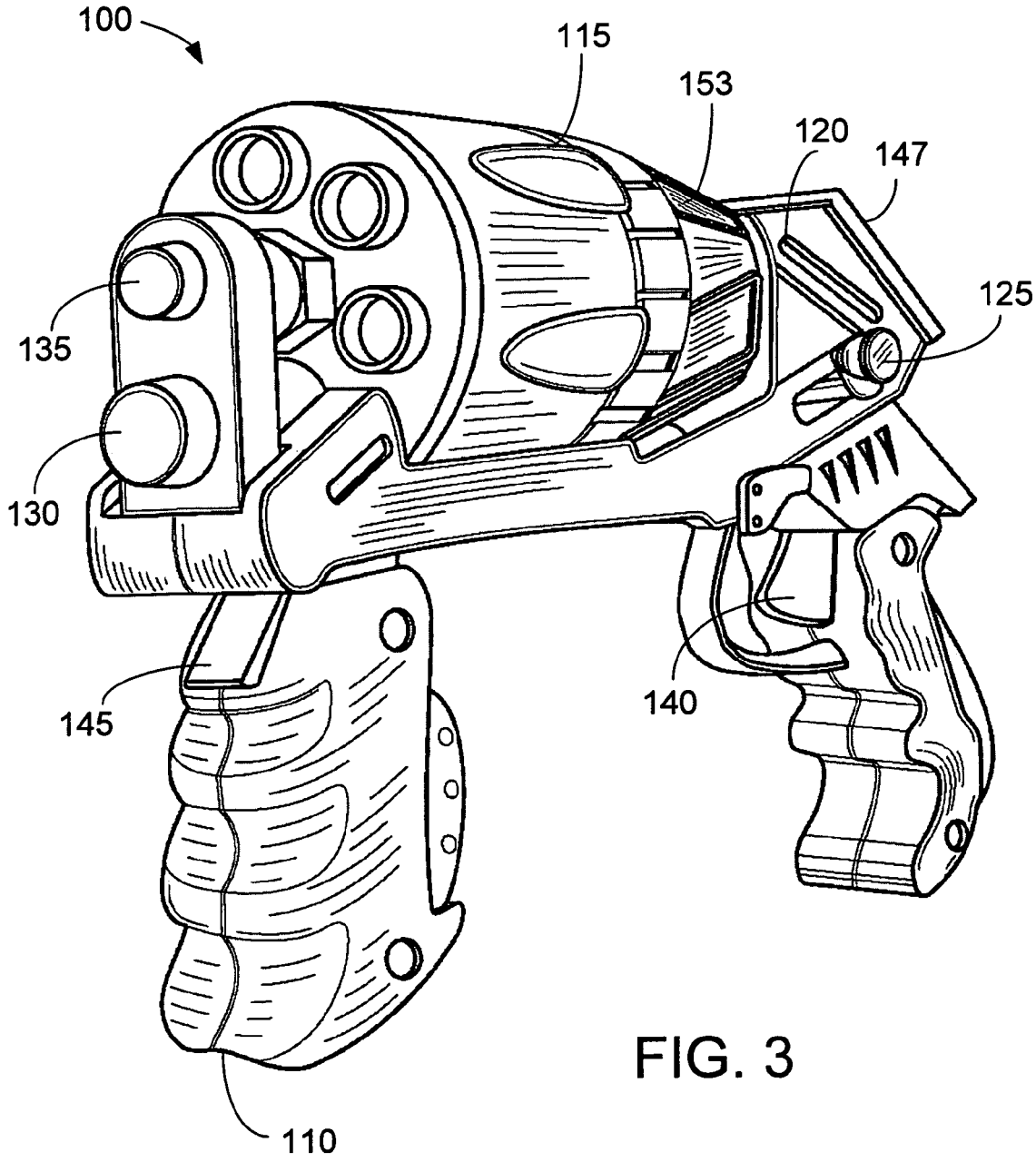
Figure 4:
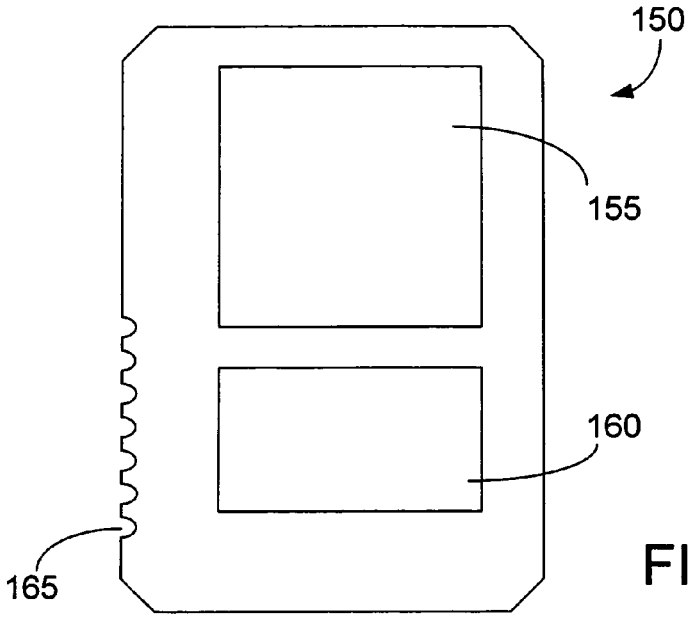
FIG. 4 is a front view of a scan card for use with the infrared shooting game gun of FIGS. 1–3.

Referring to FIGS. 1–3, an infrared gun 100 that can be used in the improved infrared gun shooting game includes a trigger handle 105, an aiming handle 110, a barrel 115, a card reader slot 120, a bolt lever 125, an infrared beam detector 130, an beam infrared emitter 135, a trigger switch 140, a weapons selector switch 145, a display screen 147, a control panel 149, an internal processor (not shown) and an internal card reader. Referring also to FIG. 4, a game card 150 is designed to be inserted into the card reader slot 120 and data associated with the card read by the internal card reader. The card is then physically mounted and stored on the barrel 115 by the player in a card holder 153.

In the improved infrared gun shooting game, each player uses the gun with one or more of the cards 150, illustrated in FIG. 4, to create a troop of robots to use in infrared shooting battles against other players and their own troop of robots. For example, each player can use a troop consisting of six robots, each of which is represented by one separate game card. The robots can be in the form of any game theme, such as futuristic warrior robots, modern day soldier robots, warrior robots from another planet, etc. The only limit on the robots usable is the imagination of the person creating the robots. Similarly, other characters not based on robots can be used in the game.

To implement the above example, each player would be issued or would select six game cards, with each game card associated with a particular robot and that robot's primary weapon, special weapon, defensive weapon, armor rating, speed rating, resistances, and vulnerabilities. No two robots have the same characteristics although players can be issued duplicate robot cards. The game card includes a first display region 155 and a second display region 160. The first display region 155 includes a visual depiction of the robot associated with that card and the second display region 160 includes a listing of the weapon characteristics of that robot. The card also includes punch holes 165 to code the identity of the robot on the card. Of course, the punch holes 165 can be replaced with any readable form of coding to encode the identity of the robot.

The robot's armor rating, which is displayed on the card, is either a heavy, a medium or a light rating, and is used to determine how hits from the various weapons damage that robot. Heavy armor reduces damage the most and light armor reduces the damage the least. The speed rating is either a fast, a medium or a slow rating and is used to determine how easy it is to hit that robot. The speed rating is implemented in the game by reducing the number of hits registered by an robot by a specified percentage based on speed rating. For example, a fast speed rating reduces by 50% the number of hits registered by an robot and that reduced number of hits is used to determine the amount of damage inflicted by the hits. Thus, while the speed rating effectively reduces the damage inflicted by the hits, it gives the players the impression that the character is moving faster and avoiding hits in that manner.

The robot's resistance rating describes the category or categories of weapons against which the robot is resistant. The resistance is implemented by reducing the damage caused by a hit of the weapon against which the robot is resistant. Thus, if a robot is resistant against an impact weapon, the damage caused by a hit from such a weapon is reduced by, for example, 40%. The resistance rating alternatively can be implemented by having the damage be reduced a different amount for each type of weapon against which the robot has resistance.

The robot's vulnerabilities rating describes the category or categories of weapons against which the robot is vulnerable. The vulnerability rating is implemented by increasing the damage caused by a hit from a weapon for which the robot has vulnerability. Thus, if a robot is vulnerable to an impact weapon, the damage caused by a hit from such a weapon is increased by, for example, 40%. The vulnerability rating can alternatively be implemented by having the damage be increased by a different amount for each type of weapon against which the robot has vulnerability. As mentioned above, each robot has a primary weapon, a special weapon, and a defensive weapon.

The main difference between special weapons and the primary weapons are that the special weapons are specified to be for limited use by the robot with which they are associated. Defensive weapons cause an infrared beam to be emitted that reduces the risk of the respective player of being hit by the opponent, or reflect a weapon shot by the opponent back at the opponent. In general, the defensive weapon notifies the other player that the defensive weapon has been activated and also causes the player's weapon to reduce or not register damage from hits from the opponents. Like the special weapons, the defensive weapons have a limited number of uses, such as three uses per robot. All three types of weapons have damage, rate, spread, and range characteristics. The primary weapons and the special weapons are generally categorized as impact, explosive, energy, high tech, elemental or toxic, with each category including one or more weapons. Different robots are resistant to or are susceptible to shots received from different categories of weapons.

The weapons selector switch 145 is used to change the type of weapon (i.e., primary weapon, special weapon, defensive weapon) used by the player. If the switch 145 is in the position associated with the primary weapon, pulling the trigger switch 140 causes a beam of infrared light to be emitted that is representative of that primary weapon. Similarly, if the switch 145 is in the special weapon position or the defensive weapon position, pulling the trigger switch 140 causes a beam of infrared light to be emitted that is representative of that weapon, respectively.

Figure 5:
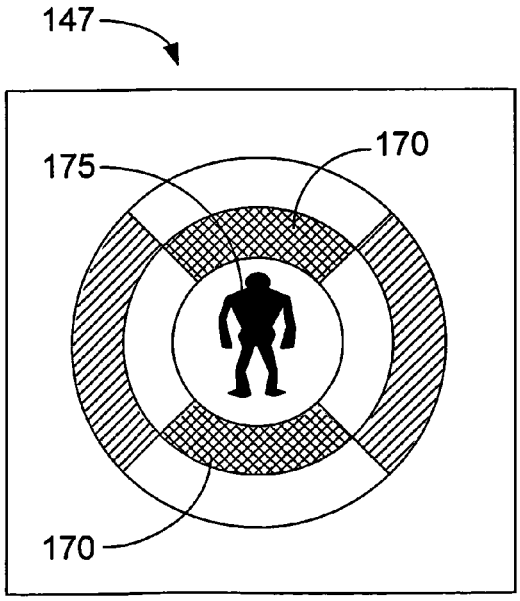
FIG. 5 is a front view of a display screen showing hits by an opponent.

As noted above, the infrared shooting game gun 100 optionally includes the display screen 147 or other feedback means, such as an audio feedback system. The feedback system keeps the player apprised of damage, hits, and energy remaining. It also can give an indication of the distance away from an opponent and the characteristics of that opponent's weapons. For example, referring also to FIG. 5, the display screen 147 can display hits against the player by displaying damage regions 170. Illuminating more regions indicates that more damage has been sustained. The display screen also can include a region 175 that contains a depiction of the robot associated with the respective player's card that is inserted into the gun 100.

Figure 6:
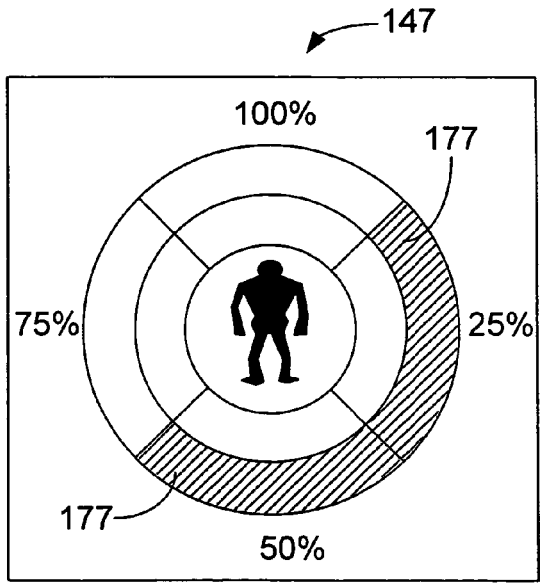
FIG. 6 is a front view of the display screen of FIG. 5 showing energy levels.

Referring to FIG. 6, the display screen 147 also can be used to show the level of energy that the player's robot has remaining. The robot displayed in FIG. 6, for example, has 50% of its initial energy remaining, as demonstrated by illumination of two energy regions 177. To change the information shown on the display screen, for example, between the level of energy remaining and the hits against the robot, the player presses a display mode button 180 on the control panel 149 on the gun (FIG. 2). The display mode button causes the screen to scroll through various displays, such as energy remaining, damage, range to opposing player, and special/defensive weapon usage remaining. The control panel 149 also includes an on/off switch 185, a track ball 190, and a single player/multi-player mode button 193. Other control buttons can be located on the control panel 149 to add extra features to the game. More detail regarding the single player mode and the use of the joystick in that mode is presented below.

An audio feedback system can be used in addition to or as a replacement to the display screen 147. The audio system uses a virtual commander to provide advice on how to proceed (e.g., a warning that the player should move closer to or further from another player based on the weapons being used by the two players), warn of impending danger, provide updates on the various robots available to the player and their weapon systems, and generally guide the player throughout a battle.

Figure 7:
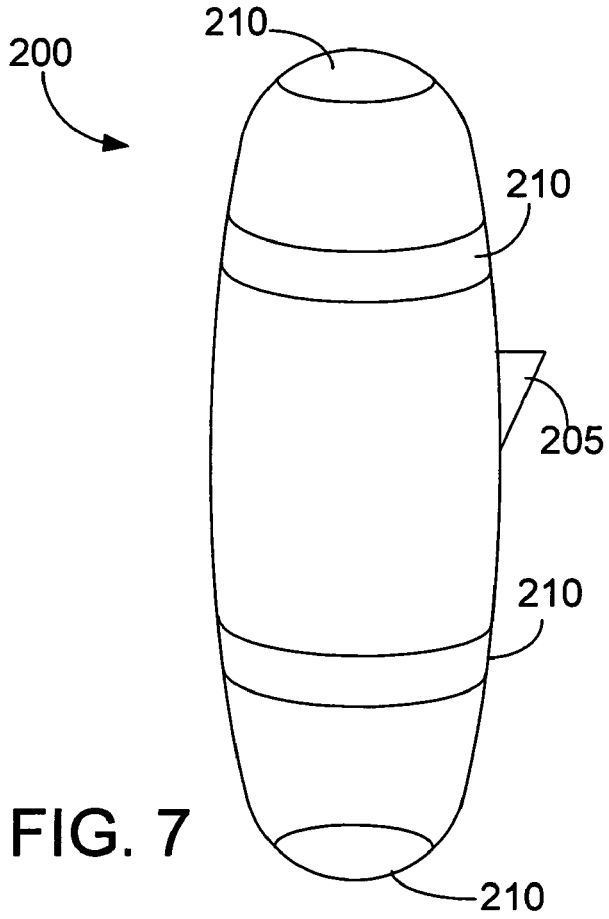
FIG. 7 is a front view of an infrared grenade for use in the infrared shooting game.

Referring to FIG. 7, the players using the infrared gun 100 in the improved infrared gun shooting game also can use the infrared grenade 200 to score hits on opposing players. The infrared grenade 200 has a time-delay switch 205 configured such that activating the switch provides, for example, a five second delay, after which an array of emitters 210 on the surface of the grenade emit infrared light over a 360° area. The infrared grenade 200 is activated and then thrown by the player in the direction of one or more opponents. It emits an infrared beam that causes a hit and damage on any opponents whose weapon detects the beam.

As described in more detail below, such weapon's characteristics can include the general classification of the weapon (e.g., impact, explosive, energy, elemental, toxic, high-tech, and defensive), the damage caused by the weapon, the rate at which the weapon can shoot, the range of the weapon, and the spread of the weapon. The damage is broken into categories, each of which is associated with an amount of damage inflicted by one hit of the weapon against an opposing player as measured by the reduction in the energy level of the opposing player. For example, damage categories and energy reductions from one hit can be light (1–10% reduction), medium (11–25% reduction), heavy (26–40% reduction) and catastrophic (41–60% reduction). The damage inflicted, however, is affected by other variables, as described below, such as the range of the weapon.

The rate at which the weapons can fire, launch a missile, or otherwise send an object at an opposing player can be, for example, continuous, semi-automatic, or intermittent. A continuous rate weapon will continue to shoot or fire at a continuous rate as long as the trigger 140 is pulled by the player. A semi-automatic rate weapon will fire as often as the trigger 140 is pulled. An intermittent rate weapon fires intermittently to mimic the effect of reloading the weapon and will fire only when the trigger 140 is pulled and only after the reload period has elapsed. Some examples of intermittent rates are one shot every one, two, three or four seconds.

The range of the weapon characterizes the optimal range in which to use the weapon against an opponent. For example, the weapons used in the game can be short range or long range or both. Thus, if a weapon is characterized as being a long range weapon, it will inflict the most damage when used at a long range (i.e., when detected and classified as a weak signal by the opponent according to a technique described below) and be less efficient at a short range (i.e., when detected and classified as a strong signal by the opponent according to a technique described below), as characterized by difficulty in hitting the opponent at short range and, moreover, inflicting less damage if the opponent is hit.

Finally, the spread of the weapon characterizes the weapon's ability to hit opponents that are within contact of a continuous infrared beam emitted by the infrared beam emitter 135. The spread can be tight, normal, wide or full. If the spread is tight, as determined according to a technique described below, a beam emitted from the infrared emitter 135 must be detected as a strong signal by the opponent (indicating that the opponent is near the center of the beam) to cause a hit. On the opposite end of the scale, if the spread is full, any opponent that is within the continuous, wide infrared beam emitted by the emitter 135 (i.e., when detected and classified as at least a minimal signal by the opponent according to a technique described below), is considered hit when the weapon is fired. To inflict damage using the normal spread and the wide spread weapons, the beams must be detected at intermediate levels of intensity, according to a technique described below.

Although the gun 100 can be implemented with a single emitter, a second emitter can be added that would be used only for the narrow beam. In addition, the single emitter alternatively can be an array of emitters to emit, in effect, a wide beam over a greater area in front of the gun.

Obviously, to the extent that signal strength is relied upon both as a means of determining the range at which a potential hit has occurred and the spread or angle from the robot at which it occurs, the distinction between range and spread is somewhat artificial. For example, a weak signal could indicate a hit at a long distance or alternatively, at a wide angle, and it may not be possible to distinguish between the two. Nevertheless, from the perspective of the players during an actual game, this distinction between range and spread would probably not be noticeable.

Although these weapon characteristics, as used in the infrared shooting game weapons, can be depicted or described on the game cards for game purposes as shooting bullets, launching missiles, throwing a flame, discharging an electrically charged dart, etc., only infrared beams are actually directed from one player to another player. To implement the improved infrared shooting game with these weapons, each gun 100 emits one or more infrared beams that are encoded with information that represents the characteristics of the firing weapon. The weapon receiving the infrared beam processes the beam to decode the information from it and determine what type of damage it has sustained. The damage sustained can be based on the level of damage that the weapon causes, the distance from which the beam was emitted (indicated by the detected beam intensity), the spread of the beam (indicated by the detected beam intensity and/or based on which emitter transmits the signal), and the category of the weapon as compared with the resistances or vulnerabilities of the robot employed by the opponent to the different categories of weapons. The rate at which the beam is fired at the weapon and received by the weapon will cause the damage to accumulate. Thus, one hit by a weapon will inflict a certain amount of damage and a repeat hit under the same conditions will double the amount of damage inflicted. Accordingly, if the player makes a hit against another player and then quickly moves before making a repeat shot, the damage inflicted may vary from the first shot depending on how much the player moved and how that movement affects the range.

The identity of the particular robot is stored on or with the card 150, for example, as a 7 bit binary code in electronic readable form, punch holes read by conductive metal fingers or transmissive optical pairs, light reflective and/or absorptive strips read by detecting reflected lights, and conductive/non-conductive strips read by electronic contact with the card. At fabrication, the characteristics of each robot is stored in the memory of the processor. Thus, entering the card allows the processor to bring up the detailed characteristics of that robot and its weapons. As shown in FIG. 4 for exemplary purposes, the card 150 uses the punch holes 165 that are read by the internal card reader in the gun 100.

As described in greater detail below, multiple cards 150 representing the identity of various robots are scanned by the card reader and read into memory. One of the robots then is selected as an active robot. A 12 bit infrared code then is transmitted from the gun. The bits are divided to encode different information. For example, bits 1–7 encode the data corresponding to the identity of the robot that is currently active with the gun, bits 8 and 9 encode the data used to determine range, and bits 10–12 encode data that is indicative of the weapon's firing condition.

The range data encoded at bits 8 and 9 use a semi-quantitative method to estimate range or distance between the gun sending out the beam and the gun detecting the beam. In effect, each gun tells other weapons how far it is from the receiving weapon and the receiving weapon does the same. To provide this information, a continuous beam of infrared light is sent. Although bits 1–7 generally do not change, bits 8 and 9 are changing continuously to provide an indication of distance. Bits 8 and 9 represent four levels of power that is transmitted by the gun 100. The intensity of the beam emitted is cycled over the four power levels in a stepwise fashion in synchronicity with the variation in the bits. The gun receiving the beam will determine whether the detected intensity of the beam exceeds a minimum threshold during each level of power. Thus, the gun that detects the beam will determine that all four power levels exceed the threshold if the gun emitting the beam is close to the gun detecting the beam. On the other hand if the guns are separated by a medium distance, the gun receiving the beam might determine that only the two highest levels of power exceed the threshold. The processor in the detecting gun would know which particular power levels have been received because that information is encoded in bits 8 and 9. For example, the lowest power level is detected only when the detecting gun is less than about fifty feet from the emitting gun. The next highest power level is detected only when that distance is less than about 100 feet. The third level of power is detected only when that distance is less than about 150 feet. The highest level of power is detected only when that distance is less than about 200 feet. Thus, if the beam is detected only at the third and fourth levels, the range is between about 100 and 150 feet. While one player's gun is detecting another player's infrared beam to determine range, it is simultaneously emitting the same signal, which is received by the other player's gun so that both guns simultaneously determine range of the other player.

The beam also contains data encoded at bits 10–12. The encoding can be, for example, as follows:

| | |
|---|---|
| 000 | Weapon not firing |
| 001 | Primary weapon firing |
| 010 | Special weapon firing |
| 100 | Defensive weapon in operation. |

Thus, the player detecting a beam from another player will also know whether he or she has been hit. In this manner, each player's gun 100 informs the player that he or she has been hit and, using the data encoded in bits 1–12, the player's gun determines the amount of damage resulting from the hits.

In the improved infrared shooting game, the general classification of weapons can be divided between impact, explosive, energy, elemental, toxic, high-tech, and defensive. Weapons in each category do not differ solely by the level of damage that they inflict, but also in their range, spread, and shooting rate. Examples of weapons within each classification and those weapons' characteristics are now explained.

The general class of impact weapons can include a heavy machine gun, a heavy cannon, a recoilless rifle, a sniper rifle, a buzz saw blade launcher, and a guided titanium boomerang. As described in general above, each individual weapon has its own characteristics of damage, rate, spread and range. For example, the heavy machine gun can be specified to inflict a moderate amount of damage, fire bullets at a continuous rate, and be optimally effective at a short range. The heavy machine gun also can be specified to have a normal spread, which is indicative of the area in front of the weapon in which the weapon is effective. For comparison, a flame thrower has a wide spread while a highly accurate sniper rifle has a tight spread.

The heavy cannon weapon can be specified to inflict a moderate amount of damage, fire artillery at an intermittent rate, such as each half second, be effective at a short or long range, and have a normal spread. The recoilless rifle can be specified to inflict a moderate amount of damage, fire semi-automatically, be optimal at a short range, and have a tight spread. The sniper rifle can be specified to inflict a moderate amount of damage, fire at an intermittent rate, be optimal at a long range, and have a tight spread. The buzz saw blade launcher launches spinning serrated blades that cut through anything and can be specified to inflict a moderate amount of damage, launch blades at an intermittent rate, be optimal at a short range, and have a normal spread. The guided titanium boomerang can be specified to inflict a light amount of damage, be launched at an intermittent rate, be useful only at a long range, and have a full spread.

The category of explosive weapons can include a rapid rocket launcher, a missile battery, and an automatic cross-bow that shoots explosive arrows. The rapid rocket launcher can be specified to inflict light damage, launch rockets at an intermittent rate, be effective at a short range or long range, and have a normal spread. The missile battery can be specified to inflict moderate damage, launch missiles at an intermittent rate, be optimal at a short range, and have a wide spread. The automatic cross-bow can be specified to inflict heavy damage, launch arrows at an intermittent rate, be effective only at a long range, and have a tight spread.

The category of energy weapons can include a pulse rifle, a pair of twin blaster pistols, an electric dart gun, a pinpoint laser, an expanding energy whip, an electro-shock blaster. The pulse rifle shoots bursts of energy pulses and is specified to inflict light damage, shoot bursts of energy at an intermittent rate, be effective at either long range or short range, and have a normal spread. The twin blaster pistols inflict light damage, shoot at a semi-automatic rate, be effective only at a short range, and have a normal spread. The electric dart gun shoots a stream of electrically charged darts that inflict light damage, shoots at a continuous rate, is effective at either long range or short range, and has a tight spread. The additional energy weapons are specified to have their respective characteristics of damage, rate, range and speed.

The other general classification of weapons can also have individual weapons with each weapon having its individual characteristics. For example, the elemental weapons include a flame thrower, a lava sprayer, a plasma cannon, and a hydro cutter. The toxic weapons include an acid blaster and the high-tech weapons include a sonic blaster. Within each category of weapons, no two weapons differ only in the damage or the rate characteristics. Specifically, two weapons with the same spread, rate, and range characteristics would also have the same damage characteristic. Similarly, two weapons with the same spread, damage and range characteristics would also have the same rate characteristic.

Although examples of general classes of weapons and individual weapons and their characteristics have been provided, other general classes and individual weapons can be implemented in the improved infrared shooting game.

During game play, each player takes a game card 150 and inserts it into the card reader slot 120. The internal card reader reads the information on the card and stores that information in an internal memory. The player then removes the card 150 from the slot 120 and places it onto the uppermost of six holders 165. An internal processor is programmed to associate that position with the card just scanned by the card reader. The player then uses the bolt lever 125 to rotate the barrel 115 and repeats the process of inserting a second card into the card reader slot 120 and placing that card on the uppermost of the six holders 165. These steps are repeated until the data on all six cards has been entered into the processor and the cards placed on the holders 165. By using the bolt lever 125, the player can switch during play between the characters loaded onto the gun by causing the barrel containing the card holder 153 to rotate.

The gun 100 emits an infrared beam from an infrared beam emitter. The emitter emits a continuous identity beam, which is approximately a 90–180 degree beam that contains signal information indicative of the robot (i.e., eTROOPER character) selected by the player. As explained above, each gun can be programmed with up to six robots or eTROOPER characters. The processor in the opponent player's gun will take that signal information and, using a display means described below, provide the opponent player with information about the robot. The beam contains data that is characteristic of the weapon being fired and, when detected by the opponent's gun, is used to determine the amount of damage suffered by the opponent. For example, the weapons vary by the range of the weapon.

Figure 8:
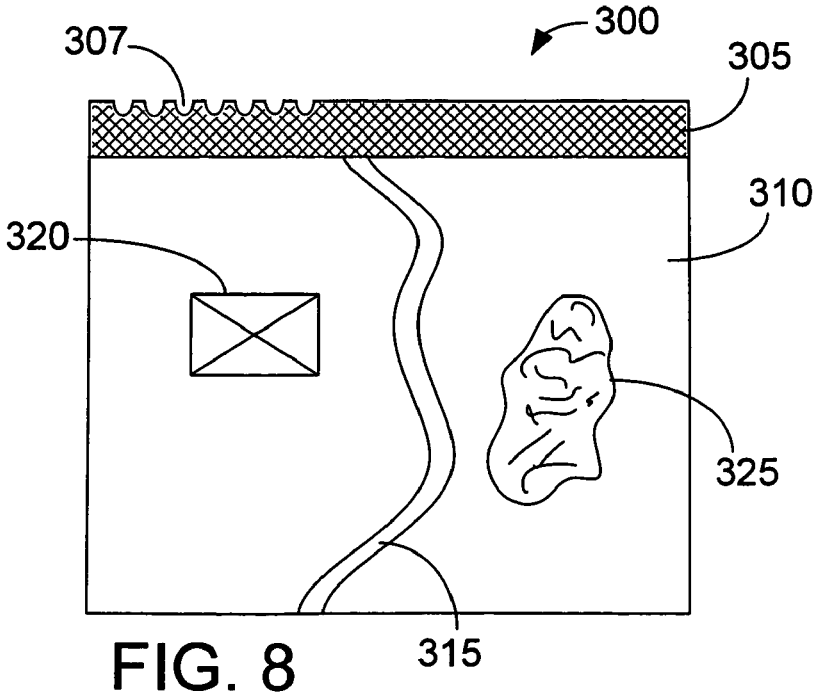
FIG. 8 is a front view of a mission card showing a mission terrain for use in the single player mode.

The gun 100 also can be used in a single player mode by moving the single player/multi-player mode button 193 (FIG. 2) to the single player mode position. Referring to FIG. 8, in the single player mode game, the player uses a mission card 300, which contains the identity of a mission that is stored in the memory of the gun 100. The player attaches the mission card to the display screen 147, which connects it to a detection device or reader on the gun to determine the identity of the mission from the card. The processor within the gun then retrieves that mission from the gun's memory.

The reader functions based on any of the methods described above for the card 150 or through any other means, such as variously arranged pins that fit within a slot in the display, to signify the code identifying the mission. For example, the identity of the mission can be read from a portion 305 of the card based on the punch holes 307 and the terrain of the mission can be displayed on a see-through terrain portion 310 of the card.

The terrain can include a variety of objects that are related to the mission, such as a river 315, a house 320, and a wooded area 325 and the player must guide an robot through those objects while battling various enemy robots appearing in that area. Because of the see-through nature of the card, information such as enemy robots still can be displayed on the screen 147 and viewed by the player in relation to the terrain of the mission.

Figure 9:
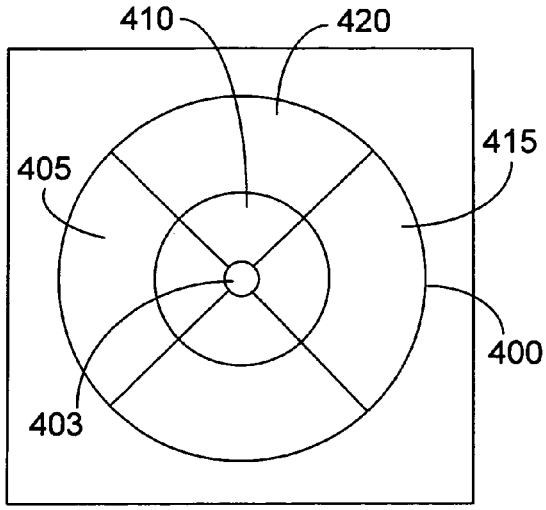
FIG. 9 is a front view of the display screen of FIG. 5 showing an enemy position screen for used in the single player mode.
Figure 10:
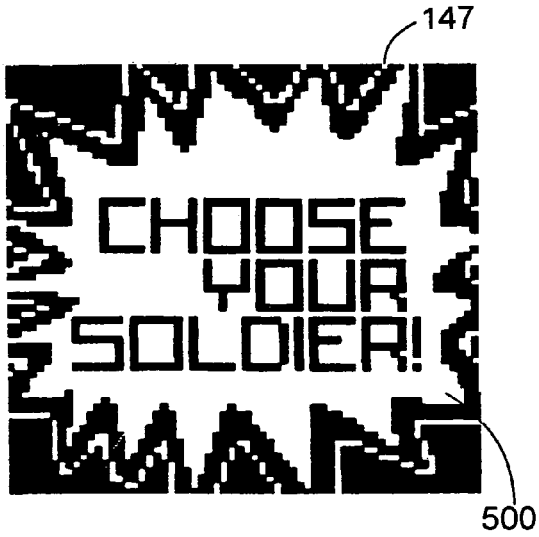
FIGS. 10–15 are front views of a liquid crystal display screen showing a sequence of game events on the display screen.
Figure 11:
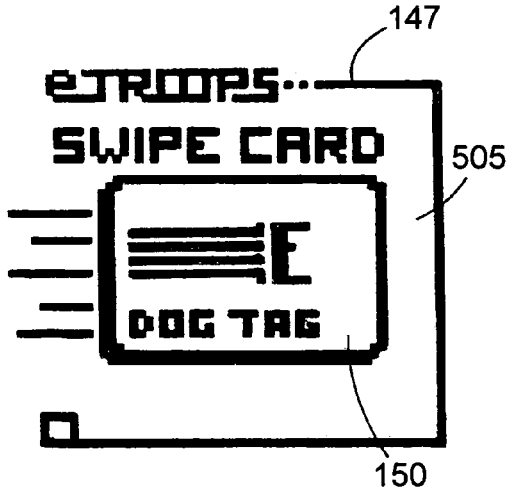

When the player is using the gun in the single player mode, the player uses the track ball 190 to move the robot through the terrain of the mission to complete the mission's objective. As illustrated in FIG. 9, the display screen 147 contains a location display 400 that includes a region 403 to indicate the position of the player's robot and multiple outer regions to indicate the position of an enemy robot relative to the player's robot. For example, if the enemy robot is in the left region 405, the player knows the enemy is to the player's left at a long distance and therefore the player should move the track ball 190 to the left to face the enemy. By moving the track ball forward, the player then "virtually" advances towards the enemy such that the enemy is in a near forward region 410. Similarly, if the enemy is in a right region 415, the player then moves the track ball to the right to move in the direction of the enemy. In either case, when the enemy robot is in the near forward region 410 or a far forward region 420, the player can shoot at the robot and expect to hit it and cause damage.

In the single player mode described above, the weapon is shot in the direction in which the robot is facing. In an alternative embodiment, the gun can be provided with a means to separately aim the gun such that the robot can face in one direction and shoot in another direction.

The near forward region 410 corresponds to a suitable range to use a short range weapon and the far forward region 420 corresponds to a suitable range to use a long range weapon. Of course, to make the game more realistic, the area and distance represented by each region can be made smaller and additional regions added to correspond to various ranges of the weapons and also to make the enemy robot harder to hit by reducing the area of each region in which the enemy can be targeted.

Although the trackball is described above as being the method of moving the player, a left/right, a left/right/forward, variable, or four direction joystick can be used. As an alternative design, an inexpensive accelerometer can be built into the gun and connected to the processor such that left and right movement of the gun can be detected. Moreover, to represent forward and reverse movement, the accelerometer can be configured to represent forward movement by tilting the gun down and to represent reverse movement by tilting the gun up.

Finally, although the single player mode was described only with respect to the information shown on the display screen 147, the audio feed back system can be active and provide the player useful information, such as warnings of nearby enemy robots, advice on weapons to use, and other information, as described above with respect to the multi-player mode.

The display screen 147 can be implemented as a liquid crystal display ("LCD") screen and used to display the information described above. Moreover, the LCD screen 147 can be used to display an opponent; display a map or scenario, which is useful in increasing the interest and realism of the game in the single-player mode; display realistic likeness of the player or the opponent, in which case the opponent can appear on the screen 147 simultaneously with the reception of the infrared beam of the opponent comes into range; display battle action and scenes; and display precise statistics for damage or energy levels.

Referring to FIGS. 10–15, which illustrates a sequence of game events on the LCD screen 147, the display can be used to provide realistic and vivid depictions of characters and instructions for playing the game. For example, referring to FIGS. 10 and 11, when initiating a game session the player turns on the toy gun or weapon and sees an initial screen 500 displayed on the screen 147. The display of the initial screen 500 is followed by the display of an instruction screen 505. The instruction screen 505 of FIG. 11 contains instructions for the player to swipe the game card 150 (FIG. 4). The instructions can provide other realistic displays of information pertinent to the selection of the game character.

Figure 12:
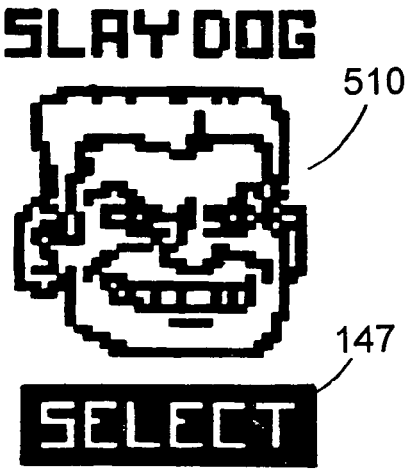
Figure 13:
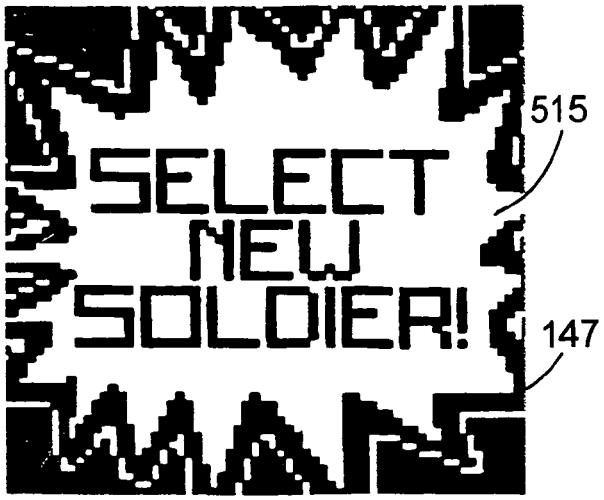
Figure 14:
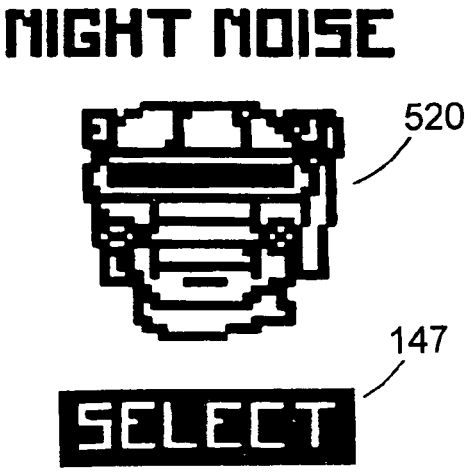
Figure 15:
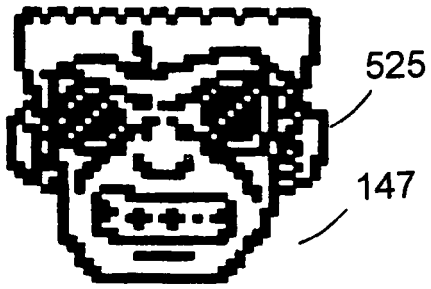

Referring to FIG. 12, after the user swipes the game card as instructed on the instruction screen 505, an identity screen 510 displays the character associated with the game card. As illustrated in the identity screen 510, the game character can be one of many characters such as SLAY DOG. The player has the option of selecting that game character or, as illustrated in FIG. 13, selecting another character using a Select New Character screen 515. As illustrated in FIG. 14, the player then can view a second identity screen 520 with a different character, such as NIGHT NOISE. The player can select that character or view another identity screen and select yet another character. For example, as illustrated in FIG. 15, the player has selected a third character, whose likeness is displayed on a screen 525.

Figure 16:
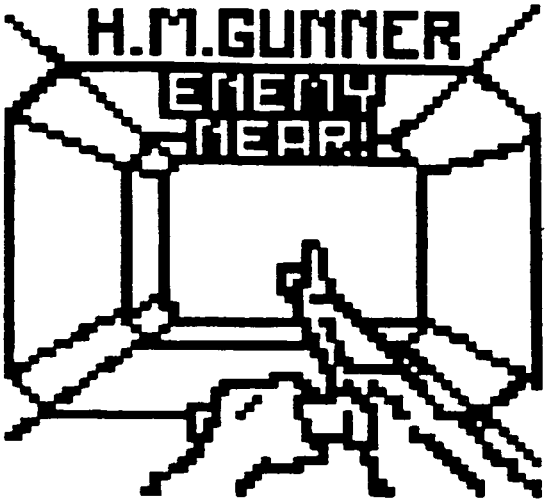
FIGS. 16–19 are front views of the LCD screen of FIG. 10 showing battle scenes.
Figure 17:
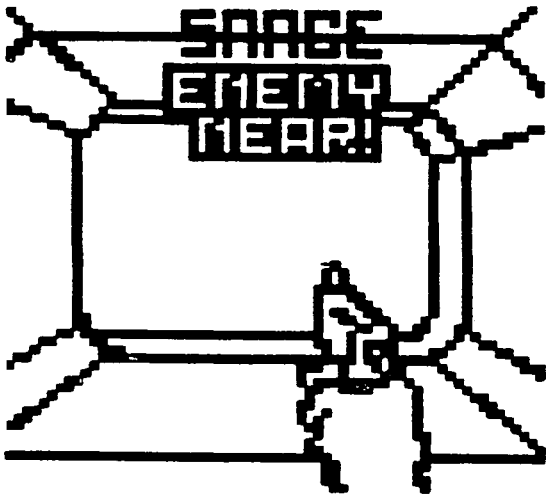
Figure 18:
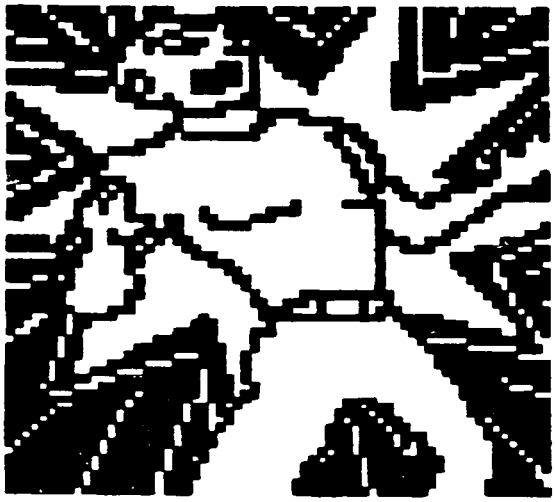
Figure 19:
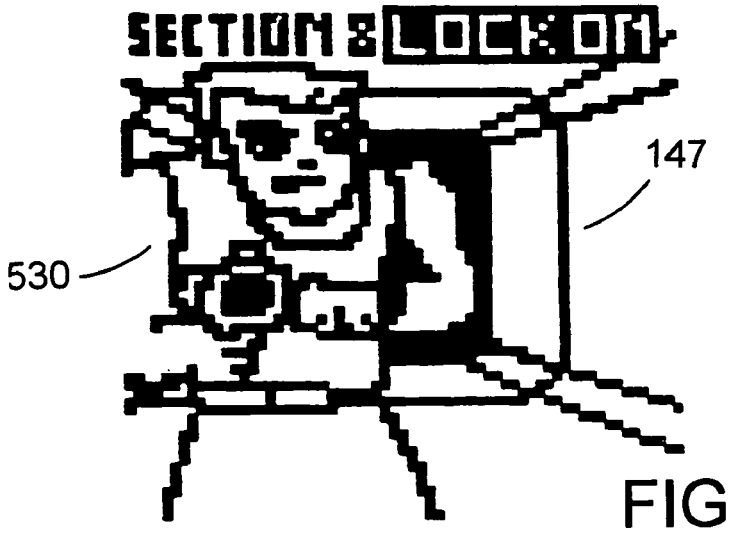

Referring to FIGS. 16–19, the LCD screen 147 can be used to realistically display battle scenes. For example, FIGS. 16 and 17 illustrate the virtual view that is viewed by the player as he enters a battle scene. The display screen 147 can include a warning that the enemy is near, as well as the name of the enemy or the name of the player's game character. FIGS. 18 and 19 illustrate various game scenes that may be displayed on the display screen 147. For example, FIG. 18 illustrates a character 530, labeled as SECTION 8, approaching the player. FIG. 19 illustrates the player battling a character 535, labeled as SARGE, with the player's weapon 540 shown on the display.

Figure 20:
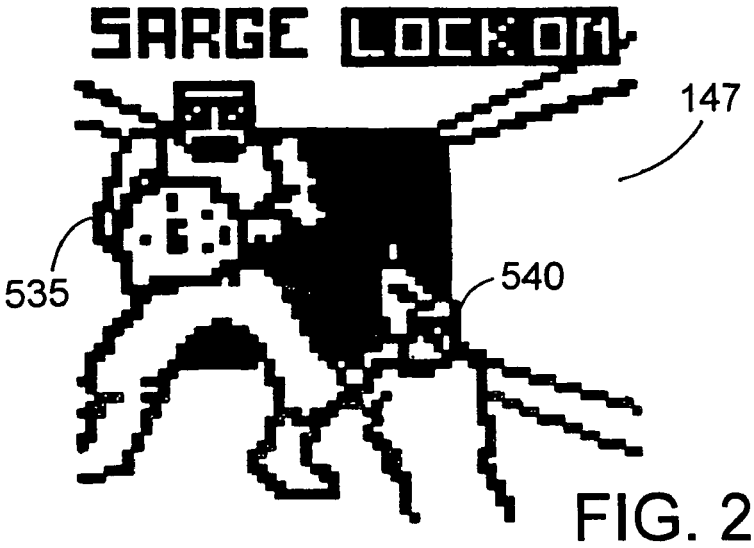
FIG. 20 is a front view of the LCD screen showing an enemy character being hit in a mock battle scene.
Figure 21:
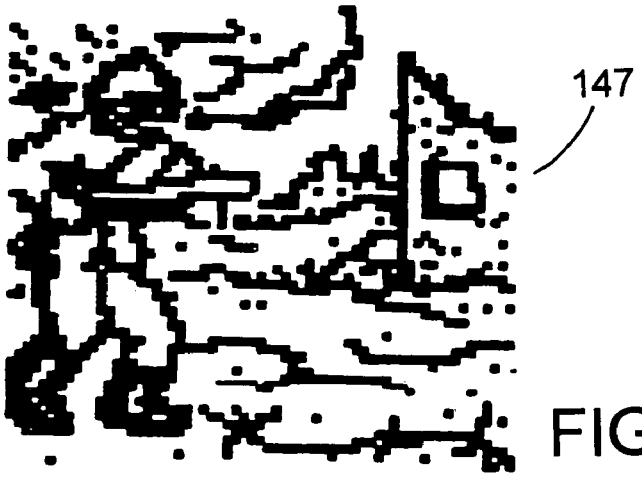
FIG. 21 is front view of the LCD screen showing a game player moving through a battle scene.

Referring to FIGS. 20 and 21, the LCD screen 147 also can be used to show the enemy character being hit by the player (FIG. 20) and the game player moving through a battle scene (FIG. 21). The battle scene illustrated in FIG. 21 can be varied and can include indoor and outdoor scenes as well as any other scene contemplated for a game. The screens illustrated in FIGS. 16–21 provide advantages, particularly for the single-player mode describe above because of the vivid and realistic scenarios possible.

Figure 22:
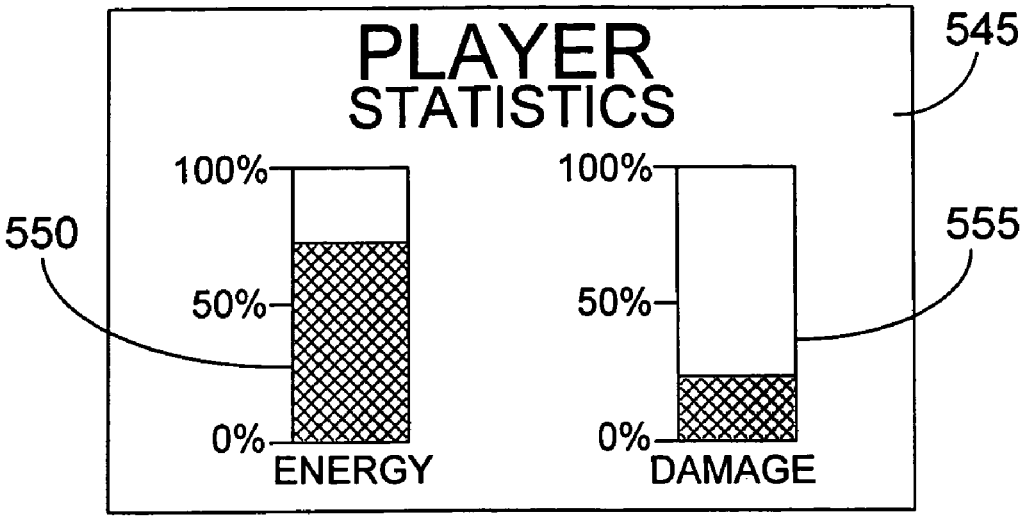
FIGS. 22 and 23 are front views of the LCD screen showing a set of player statistics.
Figure 23:
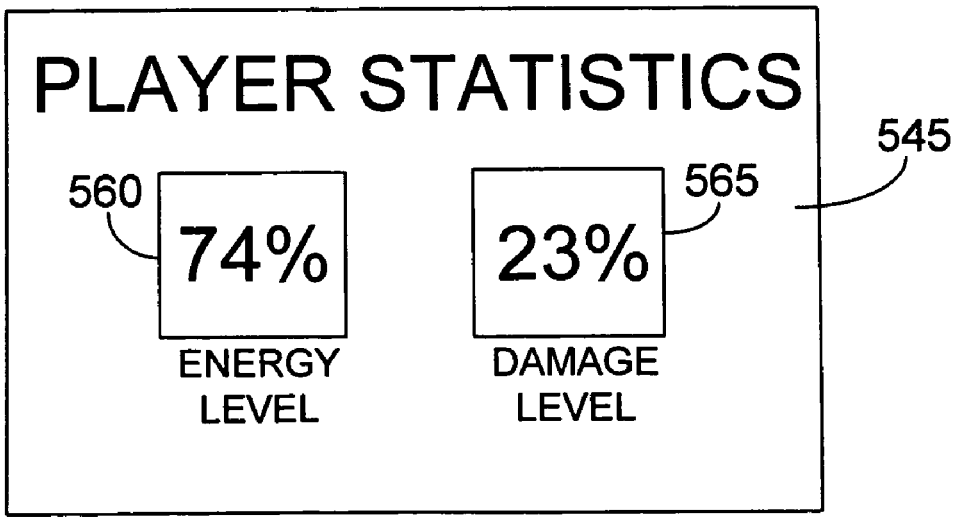

Referring to FIGS. 22 and 23, the LCD screen 147 can be used to show a set of player statistics 545, such as an energy level meter display 550 and a damage level meter display 555 (FIG. 22). Of course, the player statistics can be displayed in any form. For example, FIG. 23 shows the set of player statistics 545 as being in the form of numerical meters 560 and 565. These numerical meters can be used to displayed statistics that are as accurate or as approximate as desired.

A number of embodiments of the invention have been described. Nevertheless, it will be understood that various modifications may be made without departing from the spirit and scope of the invention. Accordingly, other embodiments are within the scope of the following claims.

What is claimed is:

1. An electronic toy gun for a toy shooting game, the toy gun comprising:

an infrared beam emitter configured to emit an encoded infrared beam;

a trigger configured to activate a state of emission of the infrared beam by the infrared beam emitter so as to indicate that a weapon is being fired; and an internal processor configured to select one of a plurality of virtual beam shapes and to cause the infrared beam emitter to emit a selectable infrared beam that is coded with one of a plurality of codes reflecting the differing virtual beam shapes.

2. The electronic toy gun of claim 1 wherein the virtual beam shape comprises a beam range.

3. The electronic toy gun of claim 1 wherein the virtual beam shape comprises a beam width.

4. The electronic toy gun of claim 1 further comprising a user input device to receive a user input configuring the internal processor to select one of the plurality of virtual beam shapes and cause the infrared beam emitter to emit the selected infrared beam that is coded with the one of a plurality of codes reflecting the selected virtual beam shape.

5. The electronic toy gun of claim 4 wherein the input device is a card reader and the user input is a card.

6. The electronic toy gun of claim 1 wherein the emitted beam shape received by an opponent determines whether the beam hits the opponent.

7. An electronic toy gun for a toy shooting game, the toy gun comprising:

an infrared beam emitter configured to emit an infrared beam;

a trigger configured to activate a state of emission of the infrared beam by the infrared beam emitter so as to indicate that a weapon is being fired;

an internal processor configured to select one of a plurality of virtual beam shapes and to cause the infrared beam emitter to emit a selectable infrared beam that is coded with one of a plurality of codes reflecting the differing virtual beam shapes and to calculate a measure of a player's game condition; and a feedback device configured to provide variable feedback corresponding to the calculation of the measure of the players game condition.

8. The electronic toy gun of claim 7 wherein the feedback device comprises a display configured to display one or more of a distance between a player and an opponent the type of an opponent's weapon, and a game character associated with the opponent.

9. The electronic toy gun of claim 7 wherein the feedback device comprises an audio device configured to provide one or more of a distance between a player and an opponent, the type of an opponent's weapon, and a game character associated with the opponent.

10. The electronic toy gun of claim 7 wherein the feedback device comprises a liquid crystal display.

11. The electronic toy gun of claim 7 further comprising a user input device to receive a user input to configuring the internal processor to select one of the plurality of virtual beam shapes and causing the infrared beam emitter to emit the selected infrared beam that is coded with the one of a plurality of codes reflecting the selected virtual beam shape.

12. The electronic toy gun of claim 11 wherein the input device is a card reader and the user input is a card.

13. The electronic toy gun of claim 7 wherein the emitted beam shape received by an opponent determines whether the beam hits the opponent.

14. The electronic toy gun of claim 7 wherein the virtual beam shape comprises a beam range.

15. The electronic toy gun of claim 7 wherein the virtual beam shape comprises a beam width.

16. An electronic toy gun for a toy shooting game, the toy gun comprising:

a plurality of infrared beam emitters each beam emitter configured to emit a corresponding different infrared beam shape;

a trigger configured to activate a state of emission of an infrared beam by one of the infrared beam emitters so as to indicate that a weapon is being fired; and an internal processor configured to select one of the plurality of infrared beam emitters and to cause the selected infrared beam emitter to emit the corresponding an infrared beam shapes through activation by the trigger.

17. The electronic toy gun of claim 16 wherein at least one the beam shapes differs by a beam range.

18. The electronic toy gun of claim 16 wherein at least one the beam shapes differs by a beam width.

19. The electronic toy gun of claim 16 further comprising a user input device to receive a user input to configuring the internal processor to select one of the plurality of virtual beam shapes and causing the infrared beam emitter to emit the selected infrared beam that is coded with the one of a plurality of codes reflecting the selected virtual beam shape.

20. The electronic toy gun of claim 16 wherein the emitted beam shape received by an opponent determines whether the beam hits the opponent.

* * * * *